US006270070B1

(12) United States Patent
Salomon et al.

(10) Patent No.: US 6,270,070 B1
(45) Date of Patent: Aug. 7, 2001

(54) APPARATUS AND METHOD FOR DETECTING AND CORRECTING HIGH STACK FORCES

(75) Inventors: James A. Salomon, Cheshire; Anthony E. Yap, Danbury, both of CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/469,019

(22) Filed: Dec. 21, 1999

(51) Int. Cl.[7] ..... B65H 7/08

(52) U.S. Cl. ..... 271/111; 271/149; 271/150; 271/152; 271/155; 271/259

(58) Field of Search ..... 271/110, 111, 271/114, 126, 31, 31.1, 149, 152, 155, 153, 265.02, 259, 150

(56) References Cited

U.S. PATENT DOCUMENTS

| | | | | |
|---|---|---|---|---|
| 3,817,516 | | 6/1974 | Lazzarotti et al. | 271/150 |
| 4,757,985 | | 7/1988 | Hamant et al. | 271/31.1 |
| 4,884,797 | * | 12/1989 | Svyatsky | 271/155 |
| 5,069,440 | | 12/1991 | Lazzarotti et al. | 271/202 |
| 5,246,223 | * | 9/1993 | Ricciardi et al. | 271/31.1 |
| 5,697,610 | | 12/1997 | Holmes et al. | 271/263 |
| 5,829,742 | | 11/1998 | Rabindran et al. | 271/150 |
| 5,934,666 | | 8/1999 | Rabindran et al. | 271/148 |
| 5,957,448 | * | 9/1999 | Frank et al. | 271/152 |
| 5,971,391 | * | 10/1999 | Salomon et al. | 271/152 |

FOREIGN PATENT DOCUMENTS

| | | | |
|---|---|---|---|
| 0 868 227B1 | 8/1999 | (EP) | B07C/1/02 |
| WO 97/22425 | 6/1997 | (WO) | B07C/1/02 |

* cited by examiner

*Primary Examiner*—H Skaggs, Jr.
(74) *Attorney, Agent, or Firm*—Alberta A. Vitale; Michael E. Melton

(57) ABSTRACT

The present invention is directed, in a general aspect, to a nudger for a mixed mail feeder and in particular to an apparatus and method for detecting high stack forces in a stack of mixed mail. The apparatus generally comprises an anti-lean sensor for detecting whether the mailpiece is positioned without improper lean and a stack force sensor for detecting high stack forces at the nudger wall. The method generally comprises the steps of sensing whether the mailpiece is positioned without improper lean and whether the stack of mailpieces is leaning on the nudger wall causing a high stack force which is detrimental to feeding the mailpieces. If high stack forces are present, the apparatus will work to straighten the stack. If the stack does not straighten, the operator is signaled to reorient the stack of mailpieces.

4 Claims, 7 Drawing Sheets

10
11
17
19
21
23
25
27
1
13a
A
13
15
7
5
65
29
3
38
150
3a
39
37
40
6
31
51
152
41
43
33
49
128
50
45
39
66
9
TO 41
TO 29
61
67
128

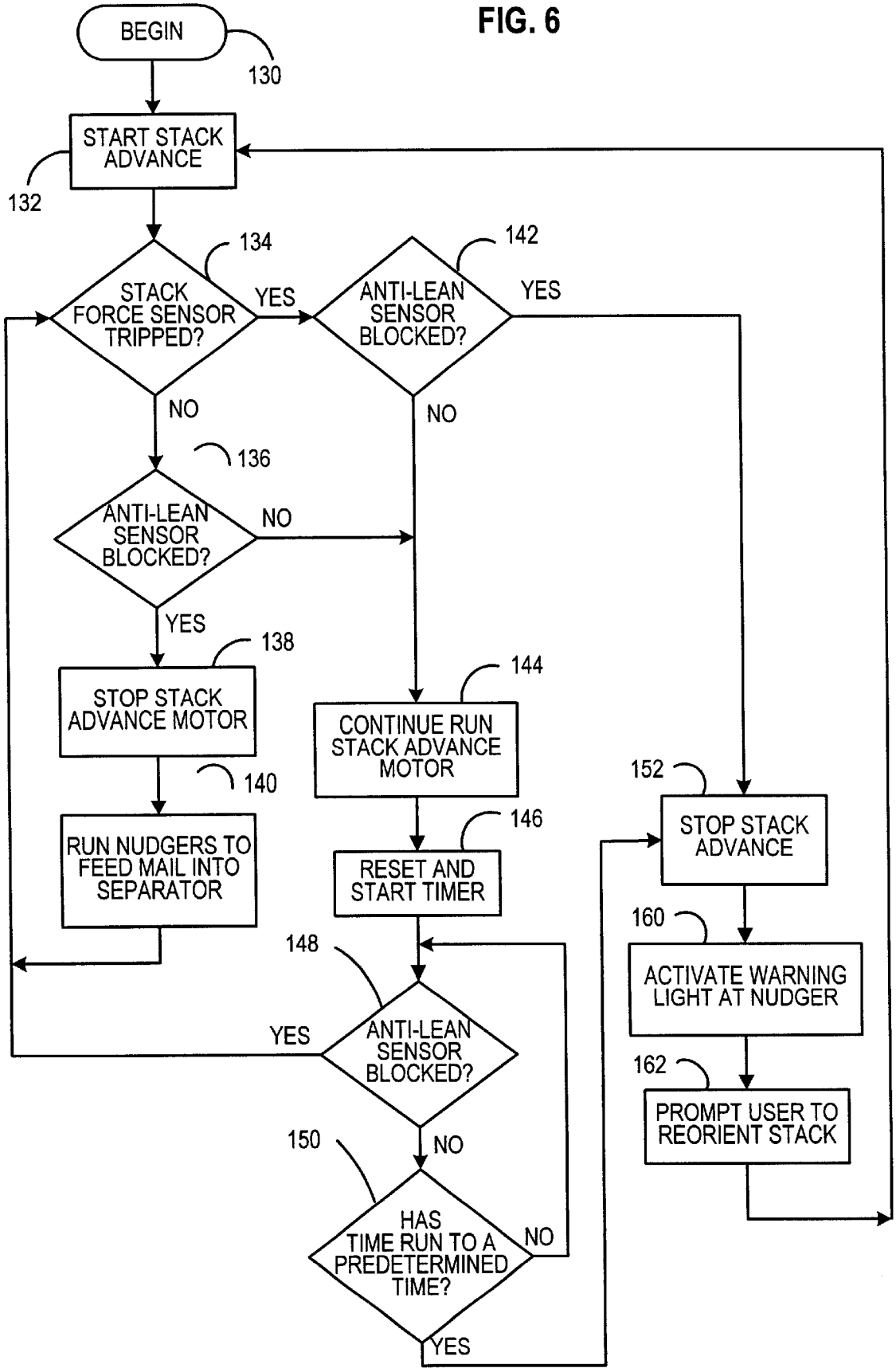
FIG. 6
BEGIN
130
START STACK ADVANCE
132
134
STACK FORCE SENSOR TRIPPED?
YES
142
ANTI-LEAN SENSOR BLOCKED?
YES
NO
NO
136
ANTI-LEAN SENSOR BLOCKED?
NO
YES
138
STOP STACK ADVANCE MOTOR
140
RUN NUDGERS TO FEED MAIL INTO SEPARATOR
144
CONTINUE RUN STACK ADVANCE MOTOR
146
RESET AND START TIMER
148
ANTI-LEAN SENSOR BLOCKED?
YES
NO
150
HAS TIME RUN TO A PREDETERMINED TIME?
NO
YES
152
STOP STACK ADVANCE
160
ACTIVATE WARNING LIGHT AT NUDGER
162
PROMPT USER TO REORIENT STACK

APPARATUS AND METHOD FOR DETECTING AND CORRECTING HIGH STACK FORCES

FIELD OF THE INVENTION

The invention disclosed herein relates generally to an apparatus for feeding and separation of mixed mailpieces and, more particularly to an apparatus and method for detecting and providing proper position of a stack of mail pieces.

BACKGROUND

The processing and handling of mailpieces consumes an enormous amount of human and financial resources, particularly if the processing of the mailpieces is done manually. The processing and handling of mailpieces not only takes place at the Postal Service, but also occurs at each and every business or other site where communication via the mail delivery system is utilized. That is, various pieces of mail generated by a plurality of departments and individuals within a company need to be collected, sorted, addressed, and franked as part of the outgoing mail process. Additionally, incoming mail needs to be collected and sorted efficiently to ensure that it gets to the addressee in a minimal amount of time. Since much of the documentation and information being conveyed through the mail system is critical in nature relative to the success of a business, it is imperative that the processing and handling of both the incoming and outgoing mailpieces be done efficiently and reliably so as not to negatively impact the functioning of the business.

In view of the above, various automated mail handling machines have been developed for processing mail (removing individual pieces of mail from a stack and performing subsequent actions on each individual piece of mail). However, in order for these automatic mail handling machines to be effective, they must process and handle "mixed mail." The term "mixed mail" is used herein to mean sets of intermixed mailpieces of varying size, thickness, and weight. In addition, the term "mixed mail" also includes stepped mail (i.e. an envelope containing therein an insert which is smaller than the envelope to create a step in the envelope), tabbed and untabbed mail products, and mailpieces made from different substrates. Thus, the range of types and sizes of mailpieces which must be processed is extremely broad and often requires trade-offs to be made in the design of mixed mail feeding devices in order to permit effective and reliable processing of a wide variety of mixed mailpieces.

In known mixed mail handling machines which separate and transport individual pieces of mail away from a stack of mixed mail, the stack of "mixed mail" is first loaded onto some type of conveying system for subsequent sorting into individual pieces. The stack of mixed mail is moved as a stack by an external force to, for example, a shearing device or nudger. The shearing device applies a force to the lead mailpiece in the stack to initiate the separation of the lead mailpiece from the rest of the stack by shingling it slightly relative to the stack. The shingled mailpieces are then transported downstream to, for example, a separating device which completes the separation of the lead mailpiece from the stack so that individual pieces of mail are transported further downstream for subsequent processing. In the mailing machine described immediately above, the various forces acting on the mailpieces in moving the stack, shingling the mailpieces, separating the mailpieces and moving the individual mailpieces downstream often act in a counterproductive manner relative to each other. For example, inter-document stack forces and normal forces exist between each of the mailpieces that are in contact with each other in the stack. The normal forces are created by the stack advance mechanism. The inter-document forces are created by the frictional forces between the documents, and potentially electrostatic forces that may exist between the documents. The inter-document forces tend to oppose the force required to shear the lead mailpiece from the stack. Additionally, the interaction of the force used to drive the shingled stack toward the separator and the forces at the separator can potentially cause a thin mailpiece to be damaged by being buckled as it enters the separator. Furthermore, in a conventional separator, there are retard belts and feed belts that are used to separate the mailpiece from the shingled stack. Both the forces applied by the retard belts and the feed belts must be sufficient to overcome the inter-document forces previously discussed. However, the force of the retard belts cannot be greater than the force of the feed belts or the mailpieces will not be effectively separated and fed downstream to another mail processing device. Moreover, if the feeding force being applied to the mailpieces for presenting them to the separator is too great, another potential problem which may occur is that a plurality of mailpieces will be forced through the separator without the successful separation of the mailpieces.

Another condition that affects the feeding of mailpieces is vertical orientation of the stack of mixed mail. The preferred orientation in which the most successful feeding occurs, is when mail is leaning slightly against the a paddle of the stack feeding device away from the nudger wall. When the mail is in this orientation, stack forces created by the weight of the mail in the stack are very low and the mail is more easily separated and aligned for feeding downstream into, for example, a separating device. The high stack forces are created by improperly loaded mail stacks or mail stacks that have shifted creating improper lean. The shifting can be caused by the inertia of the stack as it advanced, incrementally, to the shingling device. The high forces of the stack may also cause damage to mailpieces as they are fed out of the stack and can cause greater wear on the nudger or feed rollers. The high stack forces can also cause multifeeds. Additionally, improper alignment of leaning mail along the feedpath to the separating device can cause the mail to skew as it enters the separating device; the mailpiece then may also stub.

Thus, one of the problems of the prior art is that high stack forces can cause stalling of mailpieces. Another problem of the prior art is that there can be poor separation of mail. Another problem of the prior art is that mail can be damaged by stubbing. Still another problem of the prior art is that multifeeds can occur when feeding mail. Yet another problem of the prior art is that stack forces can cause increased wear on feed rollers.

SUMMARY OF THE INVENTION

This invention overcomes the disadvantages of the prior art by providing a method and apparatus for detecting and providing proper mailpiece position when feeding mixed mailpieces. This in turn affords better mailpiece processing. The present invention is directed to, in a general aspect, to a nudger for a mixed mail feeder and in particular to an apparatus and method for detecting high stack forces in a stack of mixed mail. The apparatus generally comprises an anti-lean sensor for detecting whether the mailpiece is positioned without improper lean and a stack force sensor for detecting high stack forces at the upper portion of nudger wall. The method generally comprises the steps of sensing whether the mailpiece is positioned without improper lean and whether the stack of mailpieces is leaning on the nudger wall causing a high stack force is which is detrimental to feeding the mailpieces. If high stack forces are present, the apparatus will work to straighten the stack. If the stack does not straighten, the operator is signaled to reorient the stack of mailpieces.

Thus, an advantage of the present invention is that high stack forces are detected and corrected. Another additional advantage of the present invention is that less mailpiece damage occurs. Another advantage of the present invention is that fewer multi-feeds occur. Another advantage of the present invention is that there is less wear on nudger rollers. Other advantages of the invention will in part be obvious and will in part be apparent from the specification. The aforementioned advantages are illustrative of the advantages of the various embodiments of the present invention.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIG. 6 is a flowchart of a mailpiece position detection method which may be performed with the embodiment of the mail handling machine of FIGS. 5*a*–5*c*.

DETAILED DESCRIPTION OF THE PREFERRED EMBODIMENTS

Figure 1:
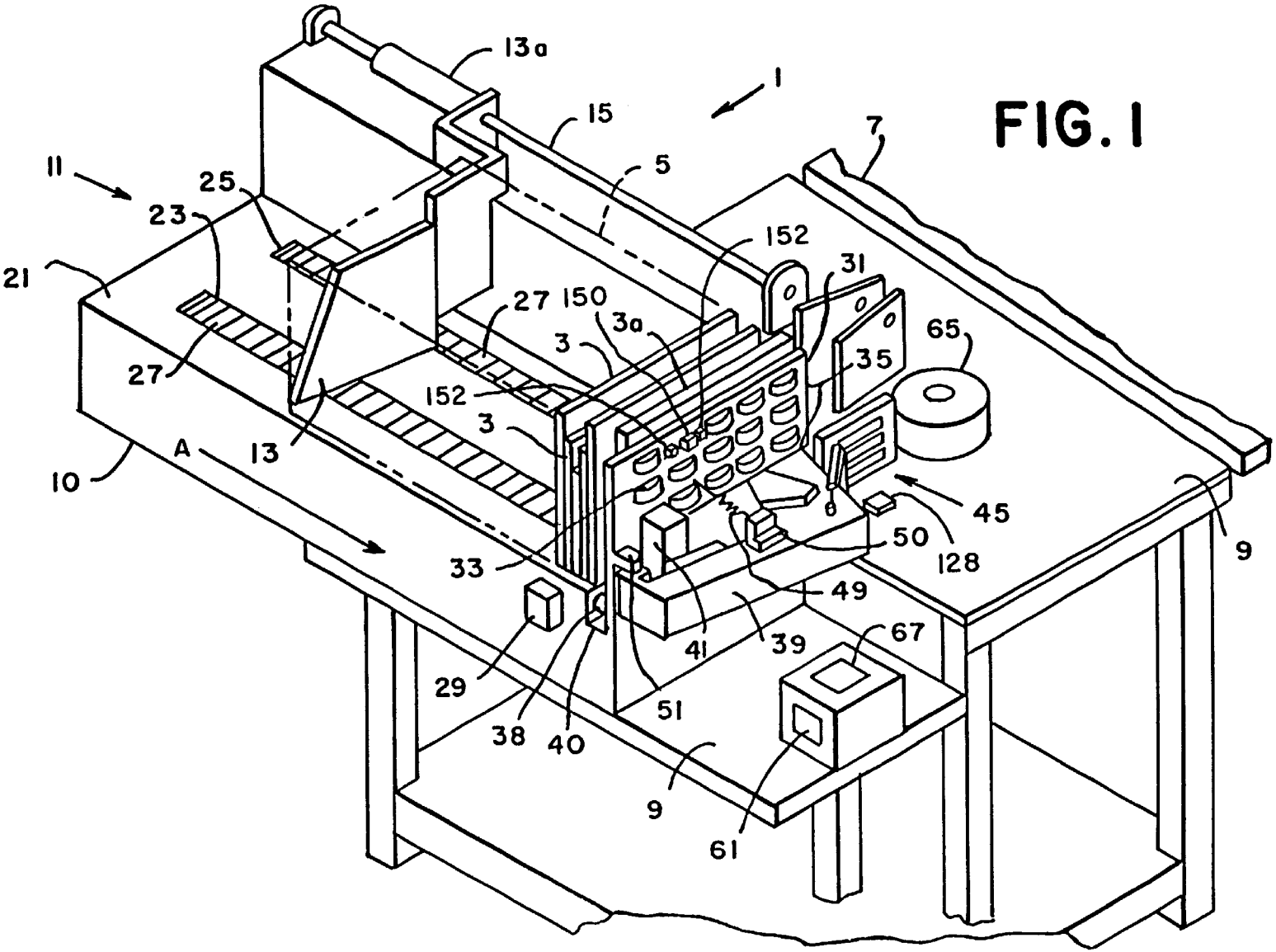
FIG. 1 is a perspective view of the inventive mail handling machine.
Figure 2:
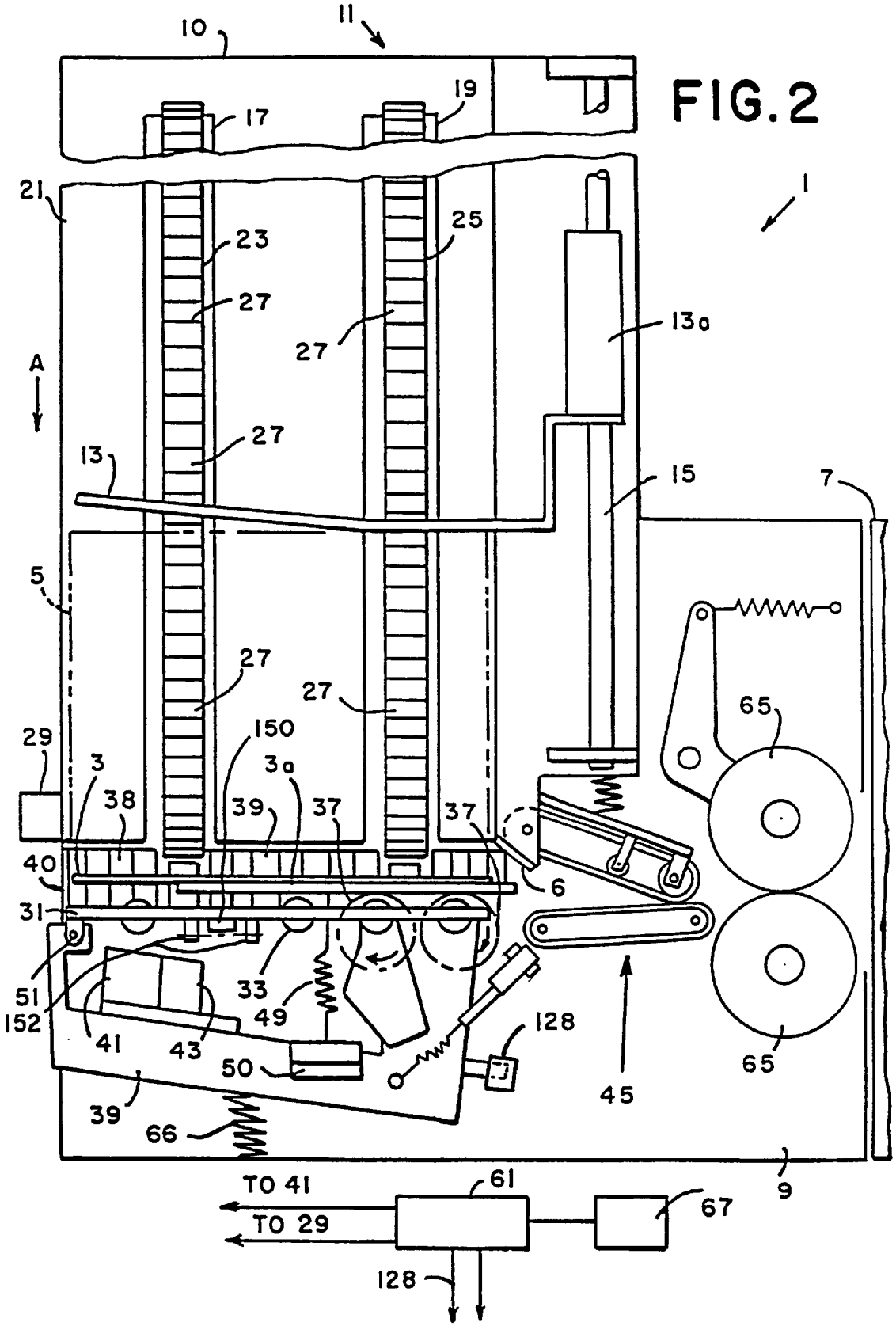
FIG. 2 is an enlarged to plan view of FIG. 1.

Referring to FIGS. 1 and 2, a mixed mail feeder 1 is shown. Mixed mail feeder 1, as will be discussed in more detail below, separates individual mailpieces 3 from a stack of mixed mail generally designated at 5 and transports the individual mailpieces 3 to a subsequent mail processing station 7. Mail processing station 7 can be any one of a plurality of devices such as a meter for printing postage on the mailpiece 3, an OCR reader for reading addresses off of the mailpiece 3, a sorting device for sorting the individual mailpieces 3 to designated bins or areas, a cancellation device for canceling postage on mailpieces 3 or even a scale that weighs the mailpiece. The key point is that the mixed mail feeder 1 functions to separate individual mailpieces 3 from a stack of mixed mail 5 and deliver the individual mailpieces 3 sequentially to the mail processing station 7.

Mixed mail feeder 1 includes a table 9 upon which all of the components of the mixed mail feeder 1 are mounted. At an input end of the mixed mail feeder 1, generally designated by the arrow 11, the stack of mixed mail 5 is placed on edge by an operator in front of a guide wall 13. Guide wall or paddle 13 acts as a support against which the stack of mixed mail 5 rests. Moreover, paddle 13 includes a cylindrical portion 13*a* which is mounted to slide on a guide rod 15 fixedly attached to platform 10 which is mounted to table 9.

Platform 10 has first and second slots 17, 19, in a horizontal surface 21 thereof. The slots 17, 19 each permit a top portion of a respective individual continuous belt 23, 25 to project therethrough. Belts 23, 25 each have a plurality of individual track portions 27 over the full extent of the belts 23, 25. The bottom of guide wall 13 removably fits in adjacent track portions 27 of each of belts 23 and 25 so that guide wall 13 moves with belts 23, 25 in the direction of arrow A (alternatively, a single belt can be used). Moreover, as guide wall 13 moves in the direction of arrow A with the belts 23, 25, the cylindrical portion 13*a* slides along guide rod 15 to keep the standing orientation of guide wall 13 in the position shown in FIG. 1.

Continuous belts 23, 25 are mounted in a conventional manner around a pulley at each end (not shown). One pulley is an idler pulley while the other is driven by a motor 29. The motor 29 drives a common shaft (not shown) connected to the drive pulleys of each of the belts 23, 25 such that the belts 23, 25 will be driven at the same velocity to move around their respective idler and driven pulleys. Thus, as the belts 23, 25 move around the pulleys in the direction of arrow A, the guide wall 13 moves therewith so that the entire stack of mixed mail 5 is moved toward a guide or nudger wall 31. As will be discussed in more detail below, the stack of mixed mail 5 will have individual mailpieces 3 moved from the stack of mixed mail 5 downstream so that the stack of mixed mailpieces 5 is continuously reduced in size. When the guide wall 13 has been moved to a point where it is desirable to add additional pieces of mixed mail to the stack 5, the guide wall 13 can be lifted out of the individual tracks 27 of the belts 23, 25 by pulling the guide wall 13 up to rotate, via the cylindrical portion 13*a*, about the guide rod 15. Once the bottom of the guide wall 13 is clear of the individual tracks 27 of the belts 23, 25, it can be slid backward in the opposite direction from that of arrow A and placed in a desired position to receive additional mixed mail.

Figure 3:
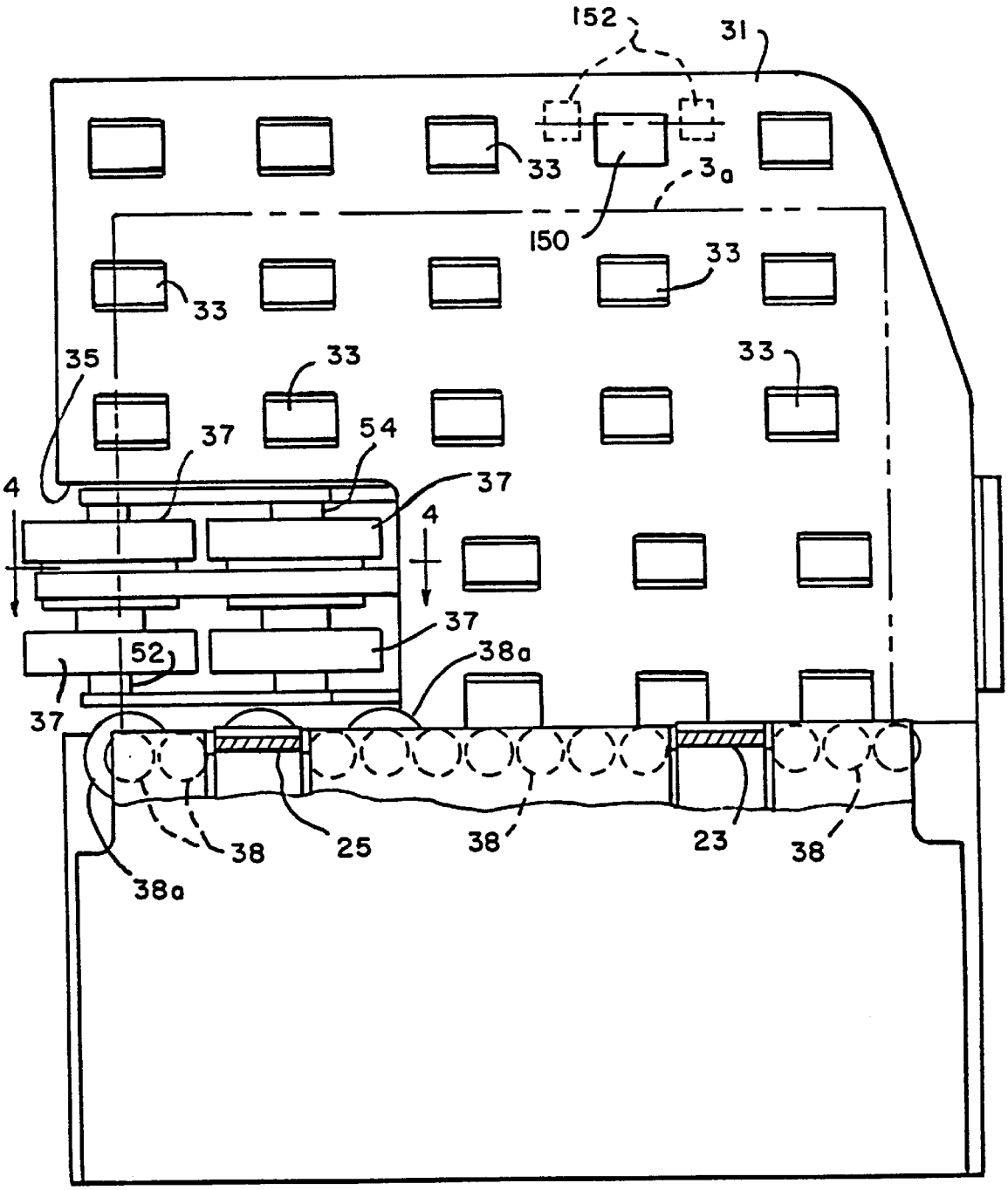
FIG. 3 is an enlarged detailed view of the nudger wall of FIG. 1.

Referring to FIGS. 1, 2, and 3, nudger wall 31 includes a plurality of rollers 33 mounted therein in a conventional manner to be freely rotatable. Furthermore, nudger wall 31 has a cutout 35 in a lower corner thereof through which driven nudger rollers 37 project. Moreover, a plurality of roller bars 38 are rotatably mounted in a conventional manner in a slot 40 of platform 10. Thus, as guide wall 13 pushes the stack of mixed mail 5 toward nudger wall 31, individual pieces of mail 3 fall off the end of belts 23, 25 on top of the rollers 38 and into contact with the nudger rollers 37. While in the preferred embodiment the roller bars 38 are not driven, they could be driven to provide additional forward feed force to the mailpiece 3. In one embodiment, a continuous belt 36 (shown in FIG. 5) is driven around the roller bars 38. Use of the continuous belt 36 provides a drive force thus improves the feed force and provides for a simple drive structure.

Figure 4:
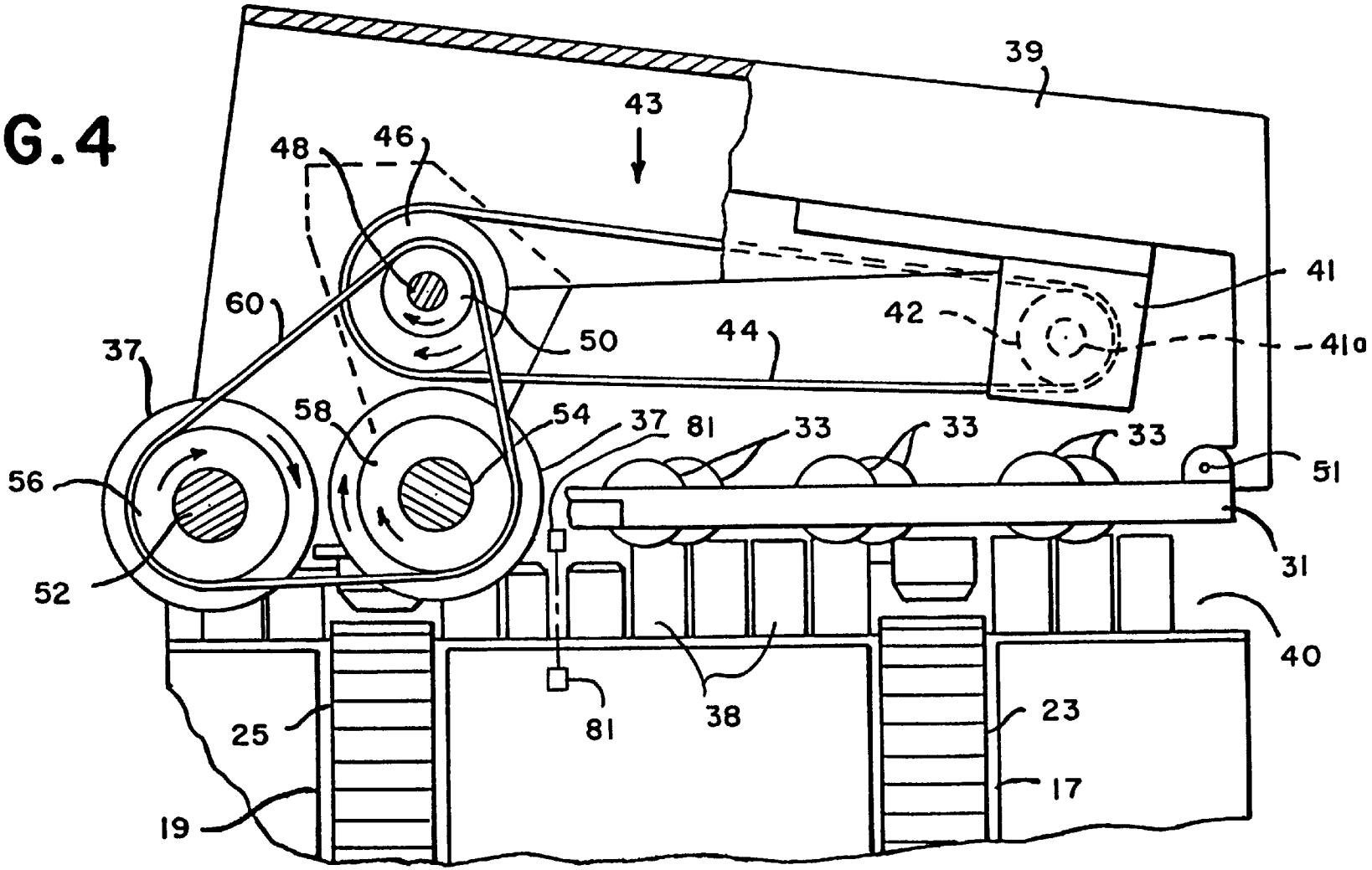
FIG. 4 is an enlarged top plan view partially in section along line IV—IV of FIG. 3 showing details of the nudger roller drive system.

The nudger rollers 37 are mounted to be driven into rotation within a nudger arm 39. The four nudger rollers 37 are driven together by a motor 41, mounted on pivoted, spring loaded nudger arm 39, via a drive train 43 as shown schematically in FIG. 2 and in detail in FIG. 4. As shown in FIGS. 2 and 4, all of the nudger rollers 37 are driven into rotation in a clockwise direction. Accordingly, as the stack of mixed mail 5 is moved toward nudger wall 31, the lead mailpiece 3*a* is forced into contact with the nudger rollers 37. The force of the driven nudger rollers 37 acts against the lead mailpiece 3*a* to move the mailpiece 3*a* in the direction of a conventional separator device 45, thereby shearing the lead mailpiece 3*a* from the stack of mixed mail 5 as shown in FIGS. 1 and 2. The shingled mailpiece is then transported to the nip of separator 45 which operates in a conventional manner to separate the lead mailpiece 3*a* from the shingled stack and deliver it to take-away rollers 65 which transport the individual lead mailpiece 3*a* further downstream to mail processing station 7. As is readily apparent to one skilled in the art, the microprocessor 61 controls all of the motors typically associated with the stack advance, shingling device, separator, and take away rollers and includes known clock structure for determining the predetermined time periods discussed above.

Referring to FIGS. 3 and 4, the details of the drive system 43 are shown. Motor 41 has a shaft 41*a* connected to a pulley 42. A continuous belt 44 is disposed around pulley 42 and a second pulley 46. Pulley 46 is fixedly mounted to a rotatable shaft 48 mounted in nudger arm 39. Also, fixedly mounted to shaft 48 is a third pulley 50. Additional shafts 52, 54 are also rotatably mounted in nudger arm 39 and respectively have fourth and fifth pulleys 56, 58 fixedly mounted thereto. Nudger rollers 37 are mounted on a corresponding one of shafts 52, 54. Accordingly, as motor 41 rotates pulley 42 in the clockwise direction of FIG. 4, pulley 46 and hub 48 are driven in the clockwise direction as well. Since a continuous belt 60 passes around pulleys 48, 56, and 58, shafts 52, 54 are forced to rotate in the clockwise direction causing a corresponding rotational movement in all of nudger rollers 37.

In order for the nudger rollers 37 to effectively feed the stack of mixed mail 5 into the separator 45, accurate control of the normal force applied to the stack of mixed mail 5 by the interaction of the guide wall 13 and the nudger rollers 37 needs to be achieved. The normal force is created by a spring 49 that is fixedly mounted at one end to the nudger wall 31 and at its other end to a mounting platform 50 of nudger arm 39. The nudger arm 39 is pivotally mounted about a conventional pivot structure 51 so that the spring 49 biases the nudger rollers 37 through the cutout 35 and into contact with the lead mailpiece 3*a*. Thus, as the guide wall 13 is advanced in the direction of the nudger wall 31, the nudger arm 39 is forced to rotate in the clockwise direction of FIG. 2 around pivot structure 51 in opposition to the biasing force of the spring 49. As the spring 49 is extended due to the rotation of nudger arm 39 about the pivot structure 51, the force exerted by the spring 49 is continually increased by a known amount. The normal force is discussed in U.S. Pat. No. 5,971,391, assigned to the assignee of the present invention, and herein incorporated by reference.

Additionally, the mail handling system 1, as shown in FIG. 4, includes a through-beam sensor 81 (anti-lean sensor) which projects a beam across opening 40 in the vicinity of nudger rollers 37 at a distance with respect to the nudger rollers that would allow the sensor to sense a short mailpiece as it travels past the nudger rollers 37. A gap exists between the rollers 38 to allow for passage of the through-beam. In some positions, the mailpiece may block or satisfy anti-lean sensor 81 as it enters opening 40, indicating that the mailpiece has proper lean. The presence of the mailpiece bottom edge may cause the microprocessor 61 to operator motor 41 to drive the nudger rollers 37. FIGS. 5*b* and 5*c* illustrate the position of the lead mailpiece 3*a* and acceptable angle with respect to the wall 31. The anti-lean sensor 81 is satisfied when the angle θ between the mailpiece and the nudger wall 31 is in a range of about 5 to 20 degrees when the mailpiece is leaning toward the wall as shown in FIG. 5*b* and in a range of about 5 to 90 degrees when the mailpiece is leaning away from the wall as shown in FIG. 5*c*. The angles correspond to the position and angle of the guide plate 6 at the entrance of the separator. That is, the guide plate 6 (shown in FIG. 2) is preferably at an angle of about 10 degrees to vertical to help prevent stubbing when mailpieces are fed in a "lean away" position.

Figure 5A:
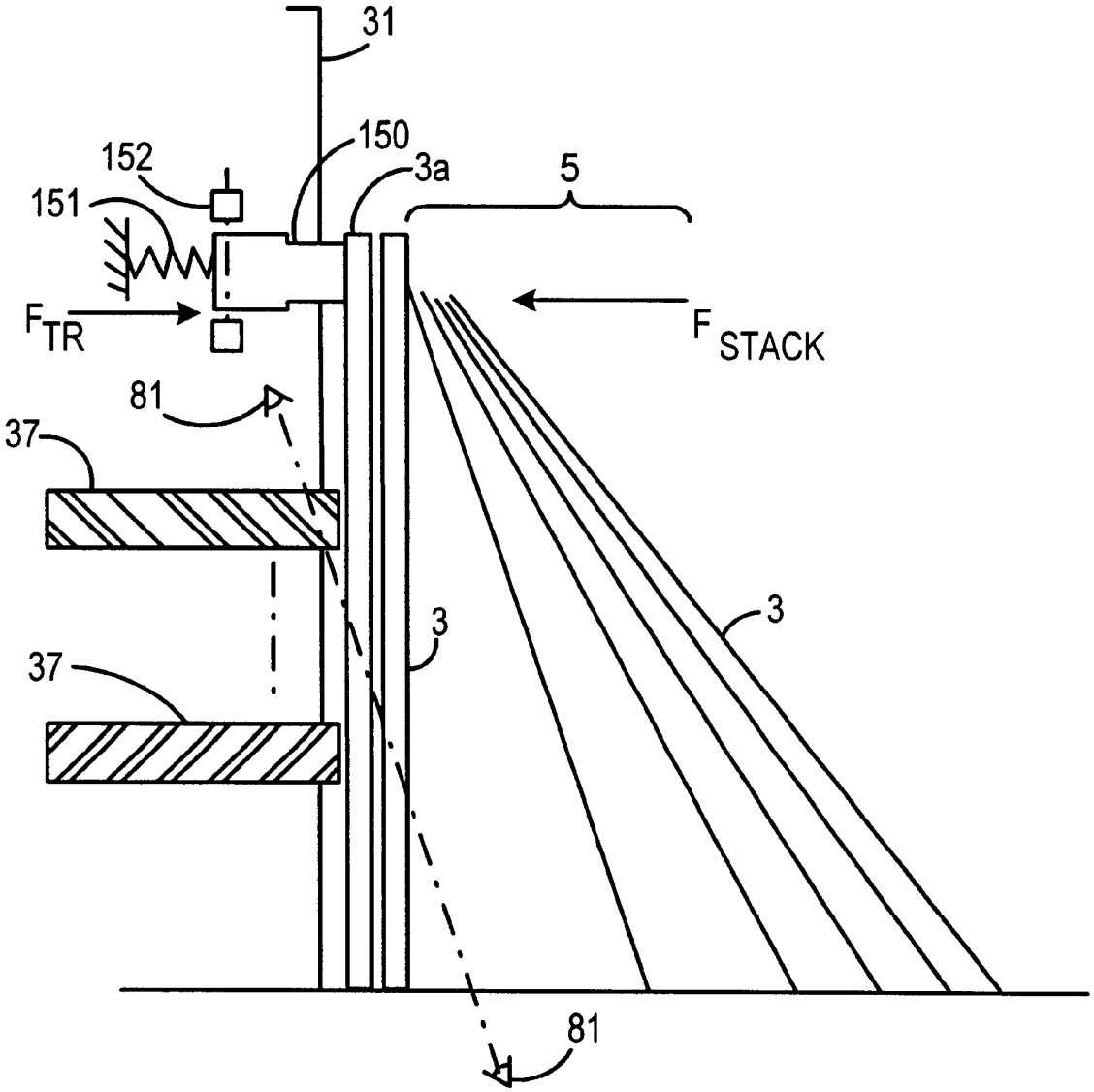
FIG. 5*a* is a simplified front view of an embodiment of the mail handling machine, illustrating vertical mailpieces in proximity to the nudger rollers with a mailpiece stack leaning against the vertical mailpieces.
Figure 5B:
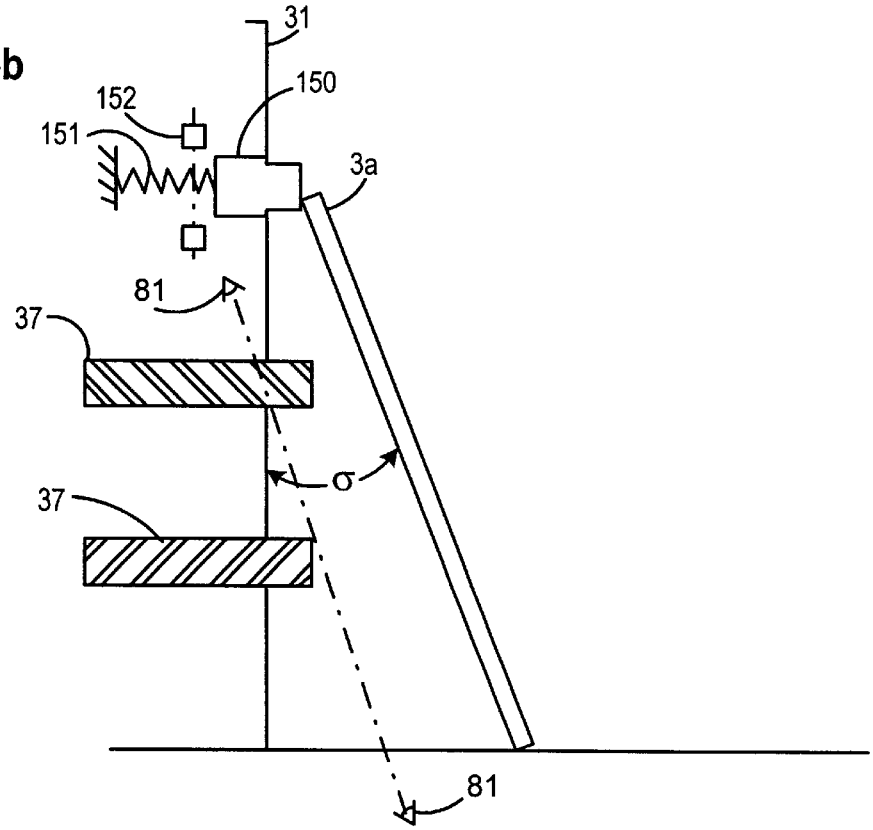
FIG. 5*b* is a simplified view of an embodiment of the mail handling machine illustrating mailpiece lean (inward toward the nudger wall) outside the path of the sensor and against the stack force sensor.
Figure 5C:
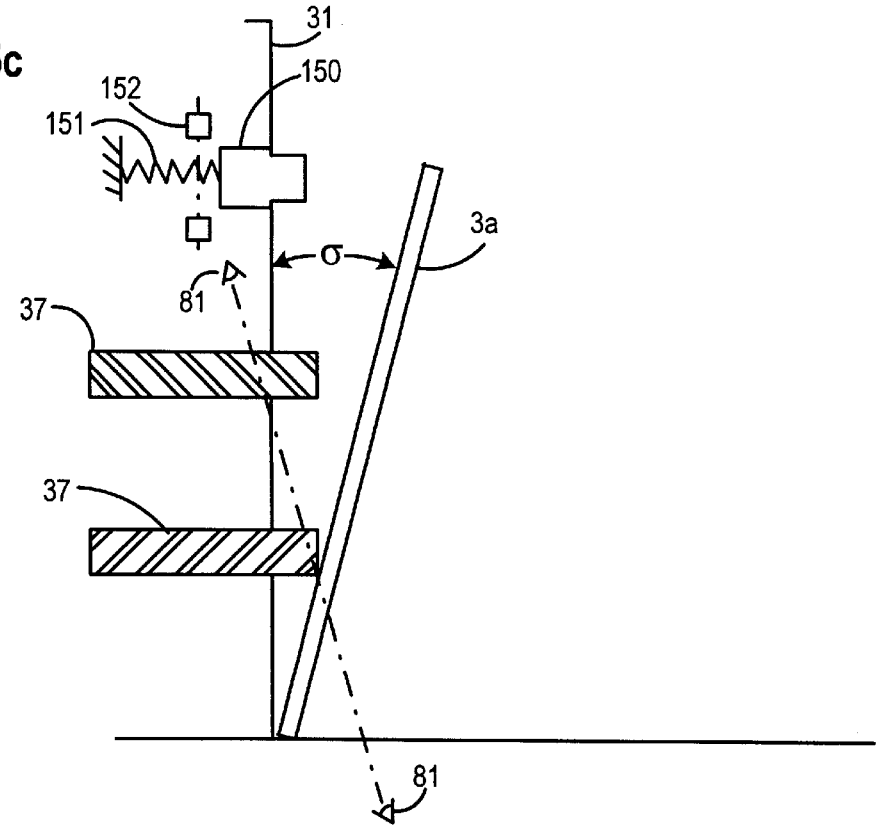
FIG. 5*c* is a simplified view of an embodiment of the mail handling machine illustrating mailpiece lean against the paddle (away from the nudger wall) in the path of the sensor and against the nudger arm.

As shown in FIG. 5*a*, a finger 150 is positioned on the nudger wall 31 above the nudger arm 39 in an area where a tall mailpiece would hit the nudger wall 31 if it were leaning in that direction. The finger 150 may be a spring biased with a torsion spring 151 and is in alignment with a through-beam sensor 152 (stack pressure sensor). The torsion spring provides a threshold force that is less than the normal force of the stack ($F_{th}<F_{stack}$) when the stack is leaning against the finger 150. Thus, when the stack is leaning against the finger 150, the finger 150 moves and blocks stack pressure sensor 152. The threshold force of the torsion spring may be determined by one of ordinary skill in the art. The stack of mixed mailpieces 5, for example can weight as much as 80 lbs. and can cause the nudger rollers 37 to need as much as 7 lbs. of additional drive force to pull the lead mailpiece 3*a* from the stack. Although the nudger rollers 37 can provide this drive force, the force created by the leaning stack of mixed mail 5 is located above the center of drive created by the nudger rollers 37. This offset of forces creates torque on the lead mailpiece 3*a* causing it to skew as it is being moved by the nudger roller 37. Additionally, high forces on the lead mailpiece 3*a* tend to damage the mailpiece 3*a* as it is fed out of the stack. The high forces also cause wear on the nudger rollers 37. High forces also effectively clamp adjacent mailpieces together causing multifeeds. The stack pressure sensor 152 helps to avoid these problems by sensing high pressure and providing a signal to microprocessor 61 that the stack pressure is too great.

When the lead mailpiece 3*a* is in an upright position, adjacent to the nudger wall 31, the sensor 81 senses the mailpiece 3*a* and the microprocessor 6*a*, absent a signal from the stack pressure sensor 152, enables the nudger rollers 37 to feed the lead mailpiece 3*a* downstream. However, with the addition of the stack pressure sensor 152, if the lead mailpiece 3*a* is in proper feed position (as sensed by sensor 81) and the stack of mixed mail 5 is leaning against the lead mailpiece 3*a*, causing a normal force at the top of the lead mailpiece 3*a* which creates a friction force that is greater than the drive force applied by the nudger rollers 37, then the lead mailpiece 3*a* will be stalled. When this happens, the stack pressure sensor 152 will prevent the enablement of the nudger rollers 37 and send a signal to the microprocessor 61 which will then signal the operator via display 67, or other suitable signal such as, for example, an indicator light or audible signal, to realign the stack of mixed mail 5.

For proper feeding, the nudger arm 39 is preferred to be in a particular position that allows the lead mailpiece 3*a* to be fed down stream without stubbing on downstream devices such as the separator device 45 or on a guide plate 6 (shown in FIG. 2). In an alternate embodiment, the position of the nudger arm 39 may also be sensed using a through-beam sensor 128 (stack advance sensor) which is preferably fixedly mounted on the table 9 or other suitable adjacent stationary portion of the mail handling device. When the nudger arm 39 rotates in a clockwise direction as the mailpiece is advanced in the direction of the nudger wall 31, the nudger arm 39 blocks the through beam sensor 128 and a signal is sent to the microprocessor 61 indicating that the lead mailpiece 3*a* is in a preferred position for feeding.

FIG. 7 is a flowchart illustrating the steps of advancing the stack of mailpieces towards the nudger arm and lean detection arm, feeding the mailpieces and controlling the stack advance. At step 130 the method begins. At step 132, the stack is advanced. At step 134, a query is made as to whether the stack force sensor is sensing high stack forces. If the stack force sensor is not sensing high stack forces, at step 136, a query is made as to whether the anti-lean sensor 81 is satisfied. If the anti-lean sensor 81 is satisfied, then at step 138, the advance of the stack of mixed mail is stopped. Next, at step 140, the nudger rollers 37 are run and mail is fed into the separator 45.

If at step 134 the response to the query is that the stack force sensor 152 is sensing high stack forces, then at step 142 a query is made as to whether the anti-lean sensor is satisfied. If at step 142 the anti-lean sensor is not satisfied, at step 144 the stack advance continues to run and at step 146 a timer is started. Next at step 148, a query is made as to whether the anti-lean sensor is satisfied. If the anti-lean sensor is not satisfied, then at step 150 a query is made as to whether the timer has reached a predetermined amount of time. The predetermined amount of time may be determined by one of ordinary skill in the art and is an amount of time that would cause the stack advance to advance and correct the mailpiece lean. The time should be enough that the stack advance will straighten the mailpiece. Preferably the time is set at about 5 seconds. If at step 150 it is determined that the timer has not run to the predetermined time, the query as to whether the anti-lean sensor 81 is satisfied is repeated at step 148. If at step 148 the anti-lean sensor 81 is satisfied, then steps 134 through 140 are repeated as described above. If at step 150 the query is answered affirmatively and the timer has run to a predetermined time, at step 152 the stack advance is stopped. Next at step 160 a warning signal is sent to microprocessor 61 and a light or other indicator such as a window on display 67 is made to create a warning to an operator of the mixed mail feeder 1. At step 162, the operator is prompted to reorient the stack. The method continues as described above, beginning at step 132.

If at step 142, the anti-lean sensor is blocked, then at step 152 the stack advance is stopped. Next at step 160 a warning signal is sent to microprocessor 61 and a light or other indicator, such as a window on display 67, is made to create a warning to an operator of the mixed mail feeder 1. The indicator could alternately be placed at the nudger wall in order to flag the particular location of the problem. At step 162, the operator is prompted to reorient the stack. The method continues to process the stack of mixed mail 5 as described above until the stack is processed, beginning at step 132.

Thus, the apparatus and method of the present invention help to overcome poor performance due to an improperly oriented stack of mixed mail. Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims.

What is claimed is:

1. An apparatus for detecting stack forces in a mail handling system which processes a stack of mail, the apparatus comprising:

a guide for holding at least one mailpiece in the stack of mail in a substantially vertical position;

a feed path positioned parallel to and at the bottom edge of the guide;

a through-beam sensor having first and second portions, the first portion positioned on the guide and the second portion positioned along the feed path for sensing the presence of the bottom edge of one or more mailpieces at the feedpath in proximity to the guide;

a sensor for detecting the presence of stack forces at the guide, the sensor positioned in proximity to the top edge of the guide, the sensor comprising a spring biased finger in alignment with a through-beam sensor, whereby the finger moves toward the through-beam sensor upon the application of a predetermined force to the finger and whereby the finger blocks the through beam sensor upon the application of the predetermined force; and whereby the sensor for detecting the presence of stack forces detects stack forces which are in excess of the range of stack forces appropriate for feeding of the stack.

2. The apparatus as claimed in claim 1 further comprising;

the guide further comprising a cutout for accommodating an arm;

the arm spring biased toward a lead mailpiece and pivotally mounted about a pivot structure such that the arm being movable between first and second positions and through the cutout in the guide, the arm for applying a feed force to a lead mailpiece of the stack of mail to feed the lead mailpiece of the stack along a mailpiece feed path, the arm comprising a finger which projects from the arm for alignment with a second sensor when the arm is in the second position;

at least one driven roller mounted on the arm positioned to be moved by the arm through the cutout of the guide, the driven roller for advancing the lead mailpiece along the feed path; and a stack advance mechanism for moving the stack of mail so that the face of the lead mailpiece contacts the driven roller; and whereby when the second sensor senses that the arm is in the second position and the sensor for detecting the presence of stack forces does not sense a predetermined stack force and the through beam sensor senses the presence of the bottom edge of at least one mailpiece, the rollers feed the lead mailpiece along the feed path.

3. A method for detecting stack forces in a nudger for a mail handling system which processes a stack of mail along a feed path, the method comprising the steps of:

a) moving the stack of mail along the feed path until a lead mailpiece of the stack of mail is in contact with the nudger;

b) determining whether the stack force at the nudger is greater than a predetermined threshold force;

c) determining whether the bottom edge of a lead mailpiece of the stack of mail has moved to a position that is in alignment with the feed path;

d) advancing the lead mailpiece along the feed path if the stack forces at the nudger are less than the predetermined threshold force and if the lead mailpiece of the stack of mail is positioned in alignment with the feed path; and e) stopping the advancing of the stack of mail if the stack forces at the nudger are greater than the predetermined threshold force.

4. The method as claimed in claim 3 further comprising the steps of:

f) determining, prior to step d) whether the mailpiece is in alignment with the feed path.

* * * * *